US010421581B2

(12) United States Patent
Oved et al.

(10) Patent No.: US 10,421,581 B2
(45) Date of Patent: Sep. 24, 2019

(54) CONTAINER

(71) Applicant: GENESISTEC LTD., Katzrin (IL)

(72) Inventors: Erez Oved, Kfar Saba (IL); Amnon Slutzki, Kibbutz Maoz Haim (IL); Sagi Slutski, Zichron Yaakov (IL); Avner Sadot, Tel Aviv (IL); Shaul Hanuna, Tel Aviv (IL); Shammai Weiss, Tel Aviv (IL)

(73) Assignee: GENESISTEC LTD., Katzrin (IL)

( * ) Notice: Subject to any disclaimer, the term of this patent is extended or adjusted under 35 U.S.C. 154(b) by 613 days.

(21) Appl. No.: 14/655,594

(22) PCT Filed: Dec. 26, 2013

(86) PCT No.: PCT/IL2013/051076

§ 371 (c)(1),
(2) Date: Jun. 25, 2015

(87) PCT Pub. No.: WO2014/102793

PCT Pub. Date: Jul. 3, 2014

(65) Prior Publication Data

US 2015/0321793 A1 Nov. 12, 2015

Related U.S. Application Data

(60) Provisional application No. 61/746,219, filed on Dec. 27, 2012.

(51) Int. Cl.
*B65D 8/00* (2006.01)
*B65D 21/02* (2006.01)
(Continued)

(52) U.S. Cl.
CPC ..... *B65D 15/16* (2013.01); *B65D 15/24* (2013.01); *B65D 21/0233* (2013.01); *B65D 21/086* (2013.01); *B65D 23/001* (2013.01)

(58) Field of Classification Search
CPC ..... B65D 21/0233; B65D 23/001; B65D 21/0234; B65D 21/0238; A47B 87/0207;
(Continued)

(56) References Cited

U.S. PATENT DOCUMENTS 3,437,258 A 4/1969 Kugler
3,604,491 A 9/1971 Spiess
(Continued)

FOREIGN PATENT DOCUMENTS

CN 1438158 A 8/2003
CN 101268903 A 9/2008
(Continued)

OTHER PUBLICATIONS

International Search Report for International Application No. PCT/IL2013/051076; dated Feb. 27, 014, two pages.

*Primary Examiner* — Anthony D Stashick
*Assistant Examiner* — Raven Collins
(74) *Attorney, Agent, or Firm* — Vorys, Sater, Seymour & Pease LLP

(57) ABSTRACT

Provided is a container including a rigid wall portion having an opening, a flexible wall portion having a corresponding opening coupled to the opening of the rigid wall portion; and a support member coupled to the rigid wall portion configured for providing the container with stability. The rigid wall portion and the flexible wall portion form together a structure configured for holding fluids.

18 Claims, 9 Drawing Sheets

(51) Int. Cl.
*B65D 21/08* (2006.01)
*B65D 23/00* (2006.01)

(58) Field of Classification Search
CPC ..... A47B 87/0261; A47B 87/0253; A47B 87/0276; A47B 87/007; A47B 87/00; A47B 87/02; A47B 47/0091
USPC ..... 215/395, 11.3; 211/71.1, 188, 194; 248/146, 150, 151, 152, 154
See application file for complete search history.

(56) References Cited

U.S. PATENT DOCUMENTS

| | | | | |
|---|---|---|---|---|
| 3,848,760 | A | 11/1974 | Rausing | |
| 4,978,025 | A | 12/1990 | Fougeres | |
| 5,224,613 | A | 7/1993 | Robbins, III | |
| 5,758,789 | A | 6/1998 | Shin et al. | |
| 5,860,556 | A | 1/1999 | Robbins, III | |
| D426,752 | S * | 6/2000 | Whaley | D7/619.1 |
| 6,092,933 | A | 7/2000 | Treu | |
| 6,568,570 | B1 | 5/2003 | Amberg et al. | |
| 6,695,757 | B2 | 2/2004 | Edwards et al. | |
| 6,921,204 | B2 | 7/2005 | Edwards et al. | |
| 7,059,487 | B2 | 6/2006 | Ohlsson | |
| 7,159,742 | B2 | 1/2007 | Lee | |
| 8,287,181 | B1 * | 10/2012 | Melvin | E04D 15/00 248/146 |
| 9,723,812 | B2 * | 8/2017 | Jones | A01K 5/0114 |
| 2009/0065505 | A1 | 3/2009 | Lai | |
| 2009/0285949 | A1 | 11/2009 | Brown | |
| 2010/0327015 | A1 * | 12/2010 | Ishii | B41F 31/02 222/105 |

FOREIGN PATENT DOCUMENTS

| | | | |
|---|---|---|---|
| EP | 0 380 110 | A2 | 8/1990 |
| EP | 1 917 890 | A1 | 5/2008 |
| EP | 2 266 893 | A1 | 12/2010 |
| EP | 2 295 328 | A1 | 3/2011 |
| EP | 2 653 064 | A1 | 10/2013 |
| FR | 2 294 927 | A1 | 7/1976 |
| GB | 781 103 | A | 8/1957 |
| GB | 823 855 | A | 11/1959 |
| GB | 2132978 | * | 1/1994 |
| JP | 11-147547 | A | 6/1999 |
| JP | 2001-225829 | A | 8/2001 |
| WO | 01/26979 | A1 | 4/2001 |

* cited by examiner

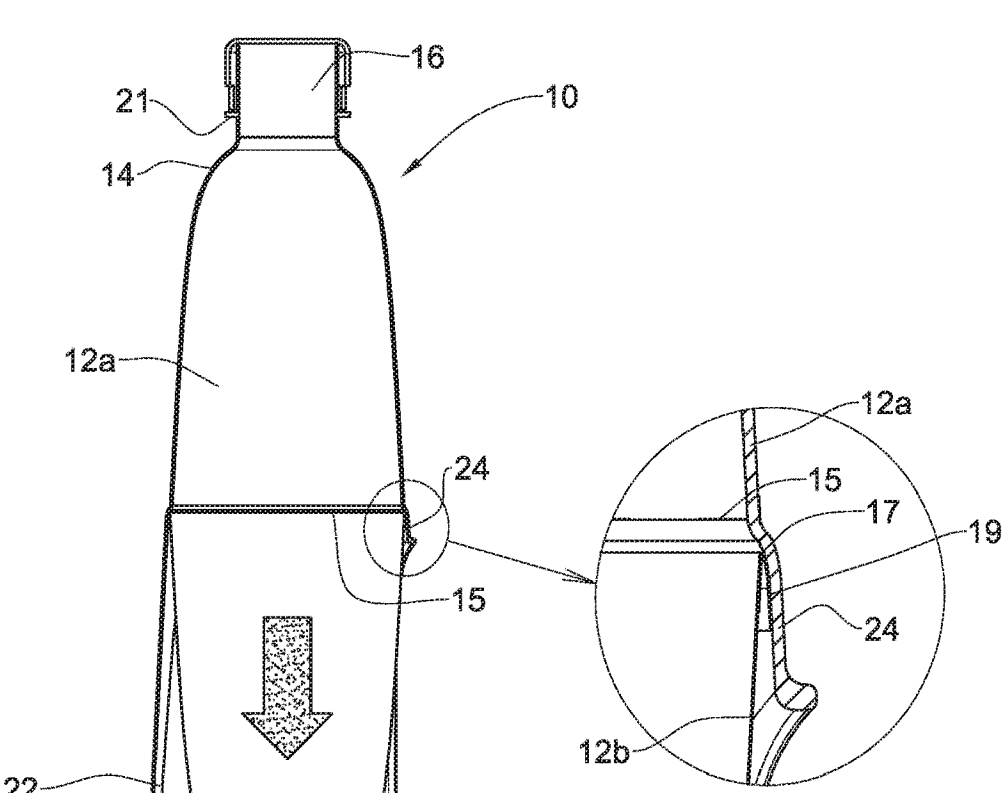
Fig. 1C
Fig. 1B
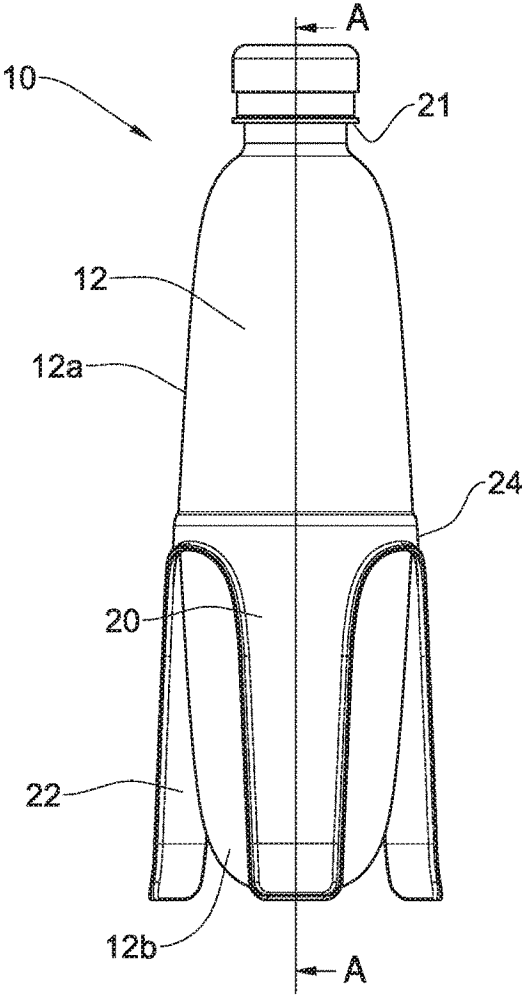
Fig. 1A

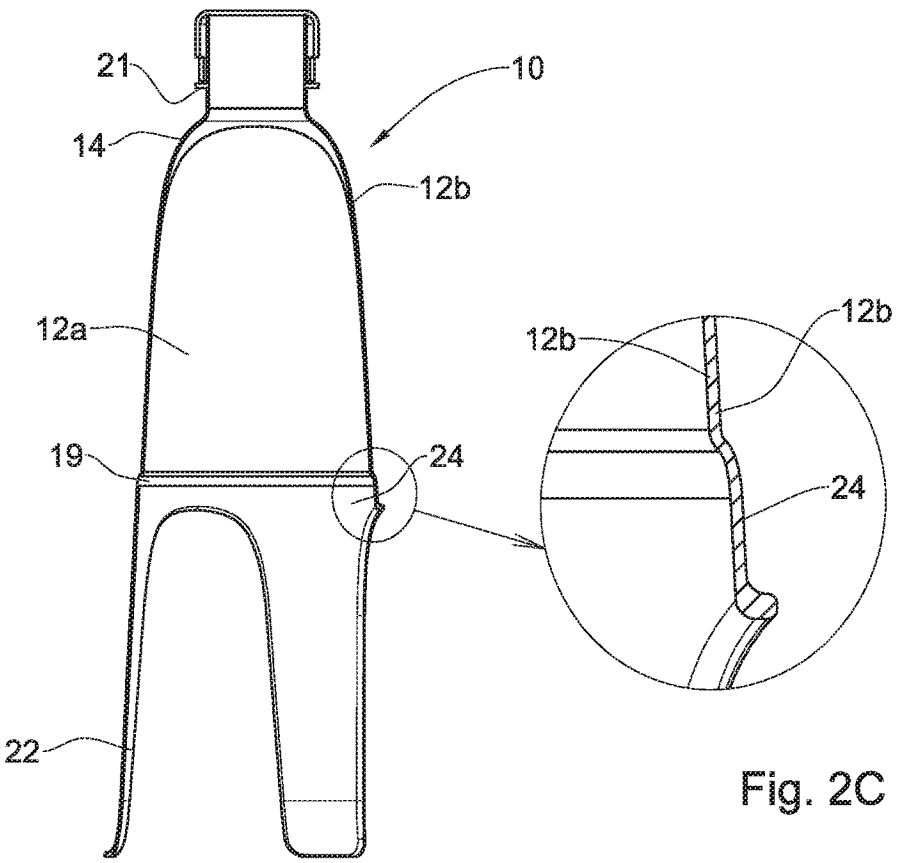
Fig. 2B
Fig. 2C
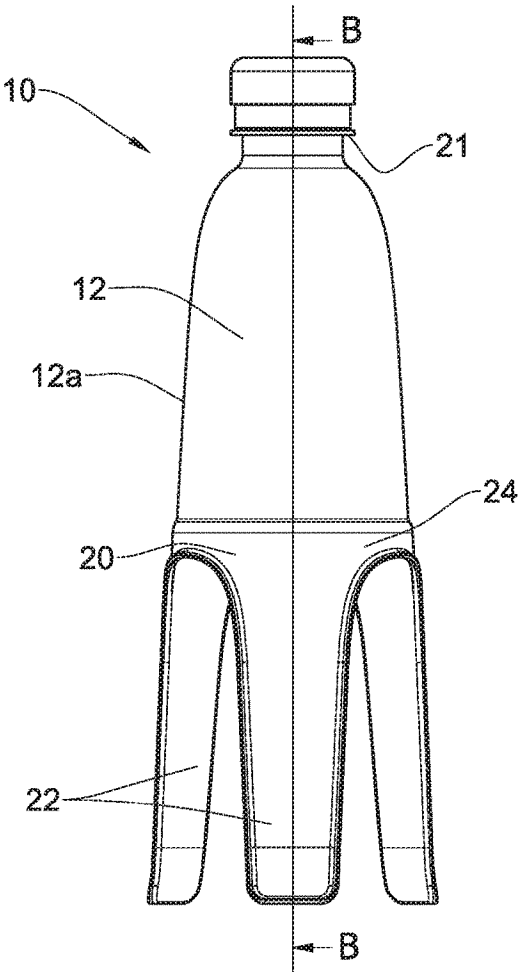
Fig. 2A

CONTAINER

TECHNOLOGICAL FIELD

The presently disclosed subject matter relates to a container in general, and in particular to a fluid container, such as a bottle.

BACKGROUND

Containers, such as bottles and other forms of packs configured for holding fluids and the like are well known and are vastly used in the market. Disposable containers and containers for dispensing machines or automatic refueling machines are also known. There are many examples of containers which have a collapsible portion thereby allowing significantly reducing the required storage space when the container is empty.

EP 2266893 for example discloses a storage container which is provided with a tube-shaped storing portion formed of a resin having an extraction opening enabling a stored substance to be sucked in a center area on one end side, and a circular opening on the other end side, and a bag-shaped storing portion which is welded along the circular opening of the tube-shaped storing portion, enters inside the tube-shaped storing portion to be able to come into intimate contact with an inner surface of the tube-shaped storing portion.

U.S. Pat. No. 7,059,487 discloses a collapsible, semi-rigid container includes neck and bottom wall portions and a peripheral side wall extending between the neck and bottom wall. The side wall includes a rigid upper portion and a flexible lower portion. The lower portion of the side wall collapses into the upper portion reducing the internal volume of the container.

U.S. Pat. No. 6,568,570 discloses packaging for a paste product provided in the form of a flexible, closed storage container which has a sealable outlet opening on the underside. The opening is adapted for connection to a metering device which conveys the product using negative pressure, permitting substantially complete emptying of the container. To this end, the flexible storage container is configured with a thinner wall in its upper section than in its lower section.

WO0126979 discloses a collapsible container which is provided for containing adhesives and sealants. The container is formed of material which is permeable to atmospheric oxygen so as to provide for the containment of anaerobic adhesives. The container includes a generally cylindrical container body defining an interior for retaining the adhesive. The container body includes a first container section defining a first portion of the interior and a second container section defining a second portion of the interior. The first and second container sections are joined together about a seam. The second container section includes a cylindrical side wall which is gradually tapered inwardly from said seam so as to permit the second container section to be easily collapsibly deformed into the first container section.

GENERAL DESCRIPTION

The presently disclosed subject matter provides a container comprising a rigid wall portion having an opening, a flexible wall portion having a corresponding opening coupled to the opening of the rigid wall portion; and a support member coupled to the rigid wall portion configured for providing the container with stability. The rigid wall portion and the flexible wall portion form together a structure configured for holding fluids.

The support member can include three legs coupled to the rigid portion. The legs can extend along the flexible portion, providing thereto stability. The flexible portion can be configured to be folded inside the rigid portion. In the folded position a plurality of bottles can be stacked up one inside the other, while the flexible portion of each one thereof extends inside the rigid portion thereof. The rigid portion can includes a diameter which is slightly gradually increasing from the neck portion on one end of the rigid portion towards the opening on the other end thereof.

The bottle can include a filling aperture and a drinking opening, the filling aperture can include a filling valve.

As used herein after, the term 'container' includes bottles, packaging, or any other form of packs configured for holding fluids, such as water, drinks, wine, milk, cooking materials, cleaning materials, or gasses of any kind.

The rigid portion can include a neck portion having a mouth.

The rigid portion can be made of resin material. The resin material can be selected from the group consisting of High Density Polyethylene, Low Density Polyethylene (LDPE), Polyethylene Terephthalate, Polyvinyl Chloride, Polypropylene, Polystyrene, Fluorine Treated, Post Consumer Resin, K-Resin and Bioplastic.

The container according to any of the preceding claims wherein the flexible portion is configured to be folded inside the rigid portion. The flexible portion can be made of a flexible thermoplastic material. The flexible thermoplastic materials can be selected from the group consisting of polyolefin, polypropylene, Low density polyethylene, Linear low density polyethylene, Polyamide, PVC, PMMA, BOPP and POPET.

The corresponding opening of the flexible portion can be welded to an inner surface of the rigid portion.

The rigid portion can further comprise a skirt disposed about the outer periphery of the opening and having a bottom portion protruding outwardly wherein the periphery of the corresponding opening of the flexible portion can be folded outwardly and down and can be welded to the inner surface of the skirt.

The flexible portion can be selectively disposed in a folded position in which the flexible portion can be disposed adjacent the inner surface of the rigid portion, and a deployed position, in which the flexible portion extends downwardly from the opening outside the rigid portion thereby expending the inner volume of the container.

The support member can be configured to allow standing the container in an upright position. The support member can comprise three legs, coupled to the rigid portion. The support structure can be integrally formed with the rigid portion. The legs can extend form the skirt. The support structure can be detachably attached to the rigid portion. The skirt includes a ring portion configured to be disposed over the outer periphery the opening of the rigid portion.

The diameter of the ring portion can be configured to apply inward radial compression forces thereby maintaining the coupling between the support structure and the rigid portion.

The container can further comprise a flange defined about the outer circumference of the rigid portion and configured to allow gripping thereby the container by a robotic arm.

The rigid portion can be configured for stacking therein a rigid portion of a second container while the flexible portion can be in the folded position thereof.

The rigid portion can include a diameter gradually increasing from a neck portion thereof towards said opening such that a rigid portion of a second container can be disposed therein.

The support structure can be configured to fasten said flexible portion to said rigid portion.

The support structure can include a snap coupling arrangement configured for coupling thereof to the rigid portion.

The opening of the rigid portion can be provided with a coupling portion defined about the circumference thereof and configured to receive therein a corresponding coupling portion defined on said support structure wherein said corresponding coupling portion can be configured for snap coupling with the coupling portion. Each of said three legs includes an outwardly protruding extension defined at the bottom end thereof configured to provide the support structure with stability. Each of said three legs can be coupled to a base member disposed at the bottom thereof.

The base member can have a shape of a ring having an aperture at the center thereof the diameter of which can be larger than the diameter of the rigid portion. The base member can be detachably attached to said three legs. The base member can further include a concaved plate disposed substantially at the center thereof, being configured to hold a bottom end of said flexible portion when in the deployed position.

The flexible portion can be disposed at the upper portion of the container when in the disposed in an upright position, while the rigid portion can be disposed at the bottom portion thereof. The flexible portion can be configured to be selectively folded inside the rigid portion. The flexible portion can include a rigid neck portion coupled thereto. The rigid neck portion can be configured to be disposed at the bottom of the rigid portion when the container can be in the folded position thereof.

The container can further comprise a filling valve. The filling valve can be disposed at the bottom of the rigid portion and the extension can be configured to be engaged by an extraction mechanism.

The support structure can be a cylindrical member or a conical member extending from the rigid portion to the bottom end of the flexible portion, such that when in the deployed position the container can be disposed in the upright position, supported by the cylindrical member or the conical member.

According to another aspect of the presently disclosed subject matter there is provided a container assembly comprising: a container comprising a rigid wall portion having an opening and a flexible wall portion having a corresponding opening coupled to the opening of the rigid wall portion wherein said rigid wall portion and said flexible wall portion form together a structure configured for holding fluids; and a support member configured to disposed thereon said container for providing stability thereto.

The support member can be configured to allow standing the container in an upright position. The support member can comprise three legs, coupled to the rigid portion. The support structure can be detachably attached to the rigid portion.

The support structure can include a snap coupling arrangement configured for coupling thereof to the rigid portion.

Each of the three legs can coupled to a base member disposed at the bottom thereof. The base member can have a shape of a ring having an aperture at the center thereof the diameter of which is larger than the diameter of the rigid portion. The base member can be detachably attached to said three legs. The support structure can be cylindrical member or a conical member extending from the rigid portion to the bottom end of the flexible portion, such that when in the deployed position the container can be disposed in the upright position, supported by the cylindrical member or the conical member.

BRIEF DESCRIPTION OF THE DRAWINGS

In order to better understand the subject matter that is disclosed herein and to exemplify how it may be carried out in practice, embodiments will now be described, by way of non-limiting example only, with reference to the accompanying drawings, in which:

FIG. 1A is a side view of a bottle in the deployed position according to one example of the presently disclosed subject matter;

FIG. 1B is a front sectional view taken along lines B-B of the bottle of FIG. 1A;

FIG. 1C is an enlarged sectional view of a portion of the bottle of FIG. 1A;

FIG. 2A is a side view of the bottle of FIG. 1A in the folded position;

FIG. 2B is a front sectional view taken along lines B-B of the bottle of FIG. 2A;

FIG. 2C is an enlarged sectional view of a portion of the bottle of FIG. 2A;

DETAILED DESCRIPTION OF EMBODIMENTS

Figure 3A:
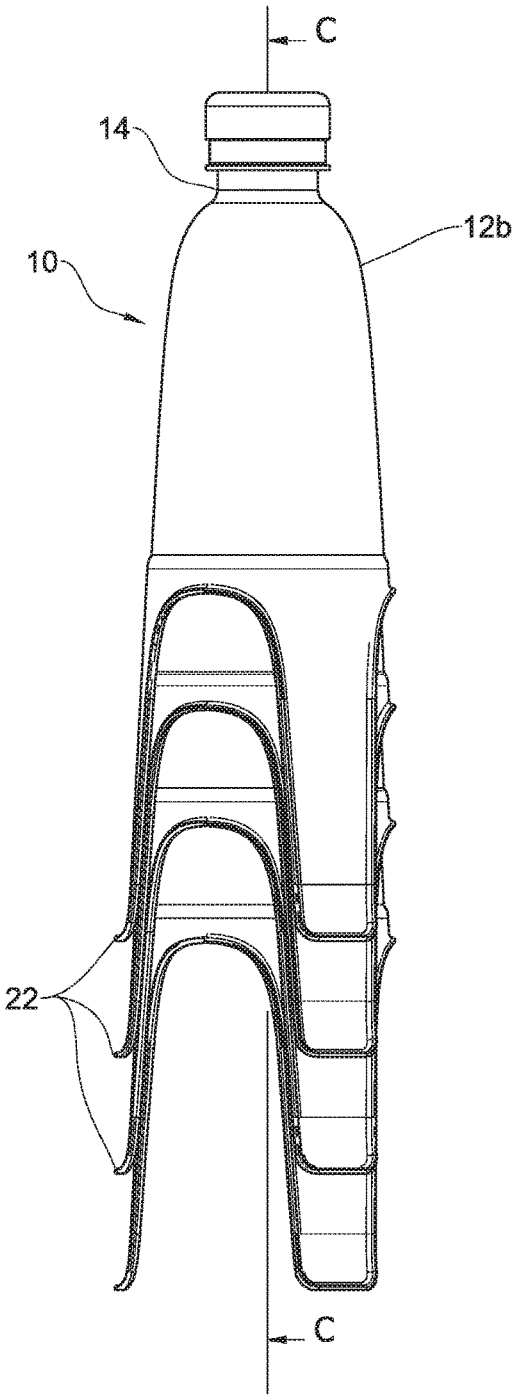
FIG. 3A is a side view of the bottles of FIG. 1A stacked up in a stack.

FIG. 1 shows a bottle 10 having a side wall 12 configured for holding fluids, such as water. The side wall 12 includes a rigid portion 12*a* having an opening 15, and a flexible portion 12*b*, having a corresponding opening 17 coupled to the opening 15 of the rigid portion 12*a*, thereby forming together an enclosed structure for holding fluids therein. The rigid portion 12*a* includes a neck portion 14 having a mouth 16. The rigid portion 12*a* can be made of resin material such as plastic, High Density Polyethylene (HDPE), Low Density Polyethylene (LDPE), Polyethylene Terephthalate (PET, PETE or polyester) Polyvinyl Chloride (PVC) Polypropylene (PP) Polystyrene (PS), Fluorine Treated (HDPE) Post Consumer Resin (PCR), K-Resin (SBC), Bioplastic, etc.

The flexible portion 12*b* is configured to be folded inside the rigid portion 12*a* for example when the bottle 10 is empty, as explained hereinafter. The flexible portion 12*b* can be made of flexible thermoplastic materials, such as polyolefin, in particular PP, LDPE, LLDPE, and PA, PVC, PMMA, or lamination sheets, such as BOPP and POPET.

As most clearly shown in FIG. 1C the flexible portion 12*b* can be coupled to the rigid portion 12*a* by welding the periphery of the corresponding opening 17 to an inner surface of the rigid portion 12*a*. The rigid portion 12*a* can include a skirt 19 disposed about the outer periphery of the opening 15, the bottom of which slightly protrudes outwardly. The periphery of the corresponding opening 17 of the flexible portion 12*b* is folded outwardly and down and is welded to the inner surface of the skirt 19. This way, as shown in FIGS. 2B through 2C, when the bottle is in its folded position the flexible portion 12*b* extends inside the rigid portion 12*a*. The wall of the flexible portion 12*b* can be configured to be disposed adjacent the inner surface of the wall of rigid portion 12*a*.

On the other hand, when the bottle is in its deployed position, as shown in FIGS. 1A through 1C, the flexible portion 12*b* extends downwardly from the opening 15 outside the rigid portion 12*a* thereby expending the inner volume of the bottle 10. Thus, the periphery of the corresponding opening 17 is attached to the inner periphery of the skirt 19, and the remaining of the flexible portion 12*b* is free to extend outwardly.

According to the illustrated example, the rigid portion 12*a* is defined at the upper portion of the bottle 10, and the flexible portion 12*a* is defined at the bottom portion thereof. In order to provide the bottle 10 with stability and to allow standing the bottle in an upright position, the bottle is further provided with a support member affixed to the rigid portion 12*a*. According to the illustrated example, the support member 20 includes three legs 22, coupled to the rigid portion 12*a*. Although in the illustrated example the legs 22 extend form the skirt 19, it will be appreciated that the legs can be coupled to any other section of the rigid portion 12*a*.

The support structure 20 can be integrally formed with the rigid portion 12*a* or can be coupled thereto by welding gluing, etc. Alternatively, the support structure 20 can be a separated element which is detachably attached to the rigid portion 12*a*. For example, the support structure can be formed with the skirt 19 from which the legs 22 extends. The skirt 19 can include a ring portion 24 which is configured to be disposed over the outer periphery of the opening 15 of the rigid portion 12*a*. The diameter of the ring portion 24 is such that when it disposed over the outer periphery the ring portion applies inward radial compression forces thereby maintaining the coupling between the support structure 20 and the rigid portion 12*a*.

The support structure 20 can be detached from the rigid portion 12*b*, by forcefully pulling the ring portion 24 off the rigid portion 12*a*. This way, the support structure can be removed by the user, for instance, before disposal of the bottle, and can be reused on another bottle.

According to one example, the support structure can be provided with a ring portion as described hereinabove, which can be further welded to the outer periphery of the opening 15 of the rigid portion 12*a*, thus, providing the bottle with additional stability and rigidity.

The bottle 10 can be further provided with a flange 21 defined about the outer circumference of the mouth 16. The flange can be used for gripping the bottle 10 by a robotic arm, such as used in a dispensing machine. The robotic arm having a corresponding gripping member can be used to lift the bottle 10 by inserting the gripping member underneath the flange 21.

Figure 3B:
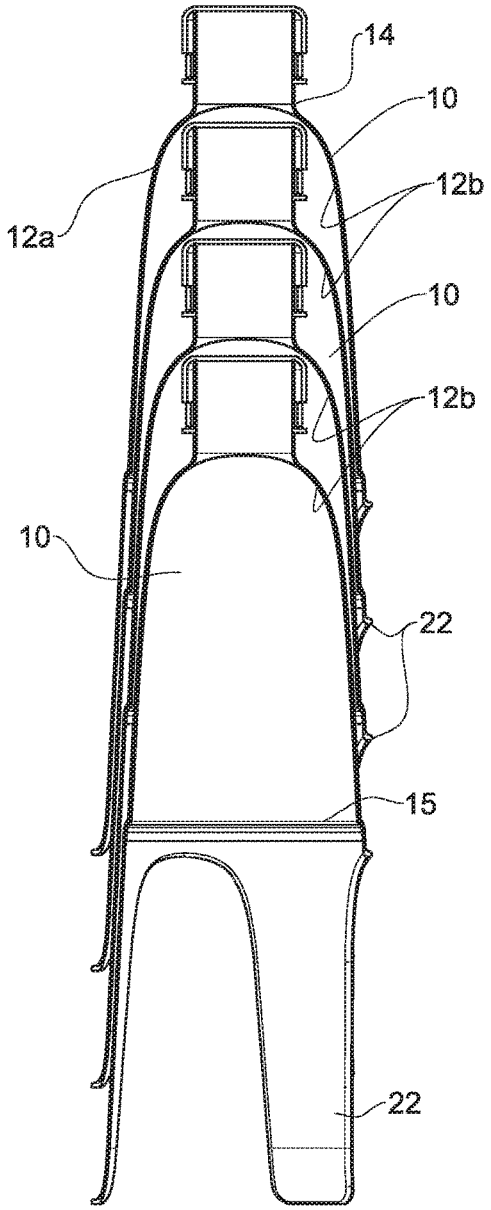
FIG. 3B is a front sectional view of the stack of FIG. 3A.

Referring now to FIGS. 3A and 3B, a plurality of bottles 10 in the folded position can be stacked up one inside the other, while the flexible portion 12*b* of each one extends inside the rigid portion 12*a* thereof. In order to provide an optimal space usage the rigid portion 12*a* includes an diameter which is slightly gradually increasing from the neck portion 14 on one end of the rigid portion 12*a* towards the opening 15 on the other end thereof. This way a rigid portion 12*b* of one bottle can be disposed inside the rigid portion of a consecutive bottle in the stack. In addition, in order to allow the support member 20 of one bottle to be disposed inside the support member of the consecutive bottle, the legs 22 can be formed with some flexibility, obviously without compromising on the stability thereof.

The flexible portion 12*b* can be such which when in the folded position it extends inside the rigid portion 12*a*, adjacent the inner wall thereof such that a rigid portion of another bottle can freely slide in and out. Further, in order to maximize the use of space when in the folded position, the flexible portion is made such that when in disposed in the folded position the top end thereof disposed inside the rigid portion reaches the neck portion 14 of the bottle 10. This way, the rigid portion of a first bottle in the stack can be disposed inside the rigid portion of second bottle with the mouth 16 thereof reaching almost at the neck portion of the second bottle.

Figure 3D:
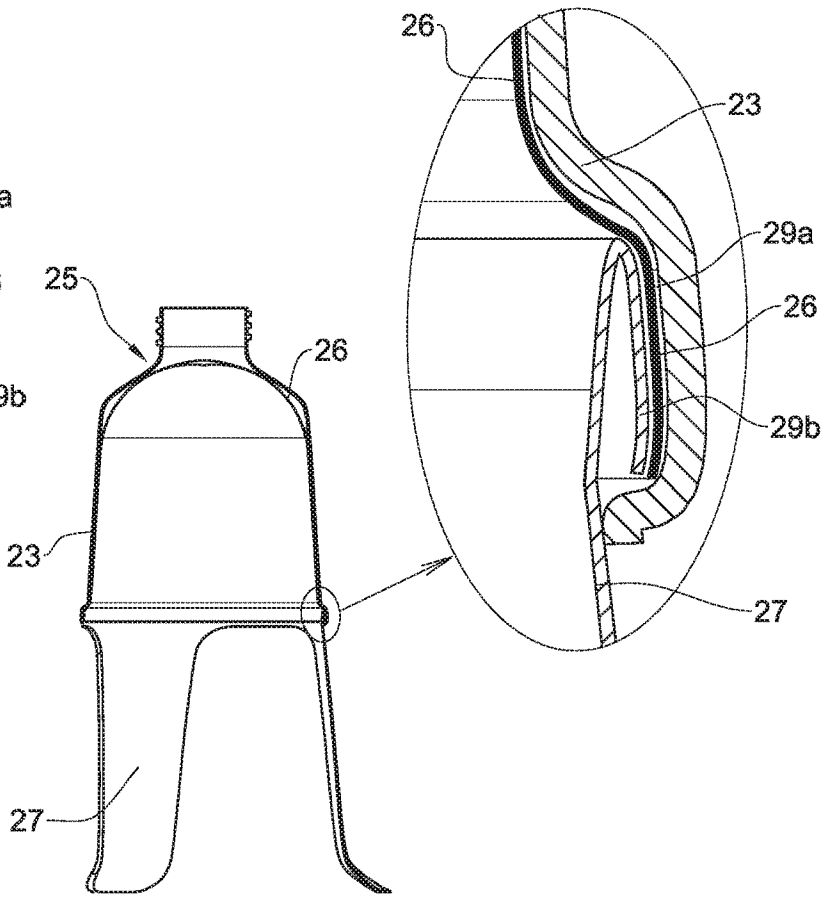
FIG. 3D is a front sectional view of a bottle according to another example of the of the presently disclosed subject matter in the folded position thereof.
Figure 3C:
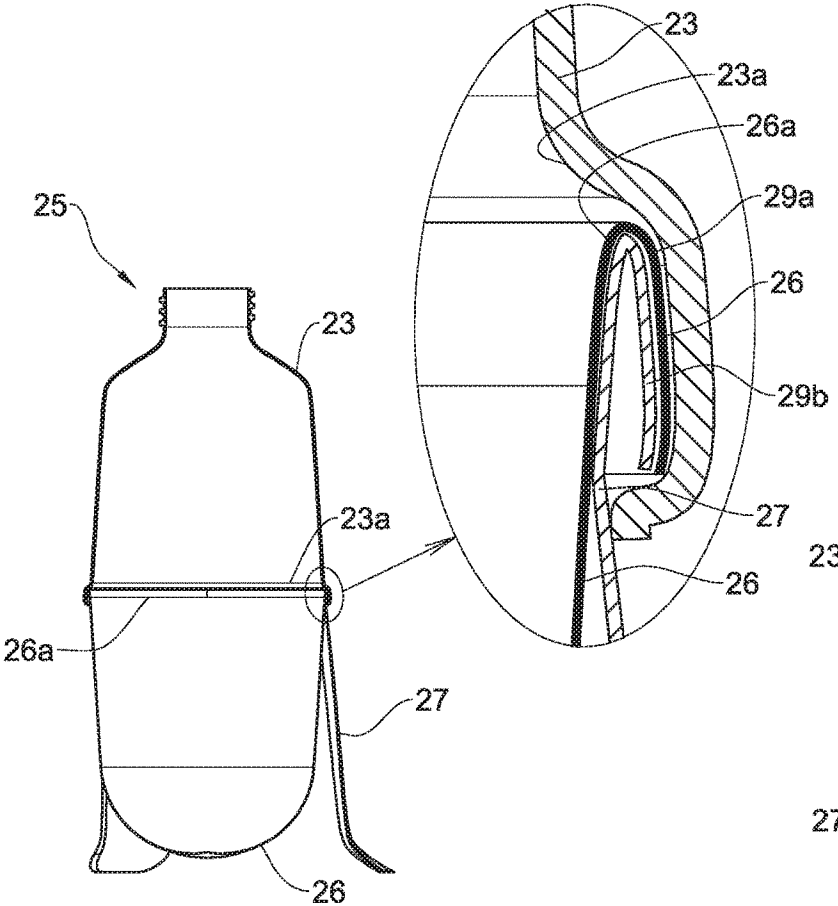
FIG. 3C is a front sectional view of a bottle according to another example of the of the presently disclosed subject matter in the deployed position thereof.

FIGS. 3C and 3D illustrate a bottle 25 constructed in accordance with another example of the presently disclosed subject matter. Bottle 25 includes a rigid portion 23 having an opening 23*a*, a flexible portion 26 having a corresponding opening 26*a*, and a support structure 27 substantially similar to those of the previous example. The flexible portion 26 according to this example is coupled to the rigid portion 23 by fastening thereof to the rigid portion together with the support structure 27. Fastening the support structure 27 and the flexible portion 26 to the rigid portion 23 can be carried out by a snap coupling arrangement. The opening 23*a* of the rigid portion 23 can be provided with a coupling portion 29*a* defined about the circumference thereof and configured to receive therein a corresponding coupling portion 29*b* defined on the support structure 27. Corresponding coupling portion 29*b* is configured for snap coupling with the coupling portion 29*a*, thereby coupling the support structure 27 to the rigid portion 23. The circumference of the corresponding opening 26*a* of the flexible portion 26 is inserted between the coupling portion 29*a* and the corresponding coupling portion 29*b*, thus when the coupling portions are snap coupled to one another the flexible portion 26 is fastened to the rigid portion. It is appreciated that the snap coupling arrangement of the coupling portion 29*a* and the corresponding coupling portion 29*b* can be configured to provide a fluid tight sealing arrangement therebetween. Thus, the rigid portion 23 and the flexible portion 26 form together a fluid tight container.

Figure 4A:
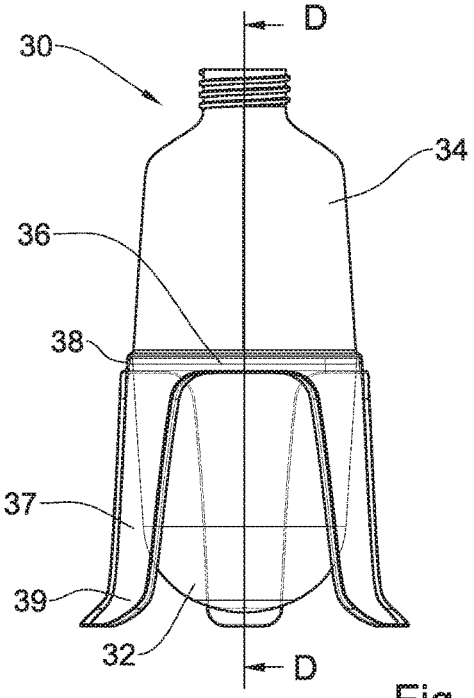
FIG. 4A is a side view of a bottle according to another example of the presently disclosed subject matter in the deployed position.
Figure 4C:
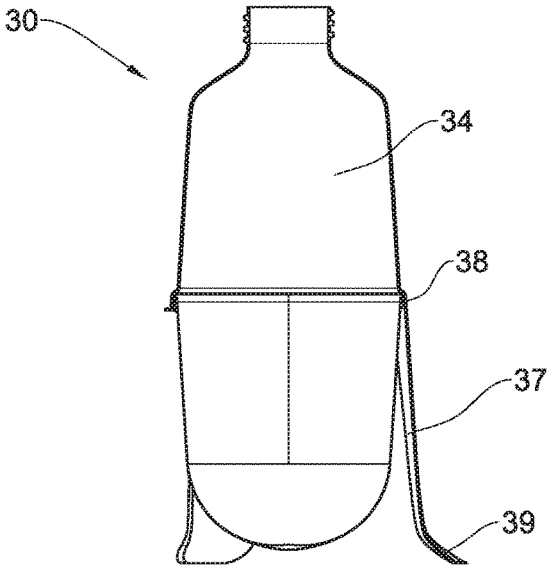
FIG. 4C is a partial cutaway side perspective view of the bottle of FIG. 4A.
Figure 4B:
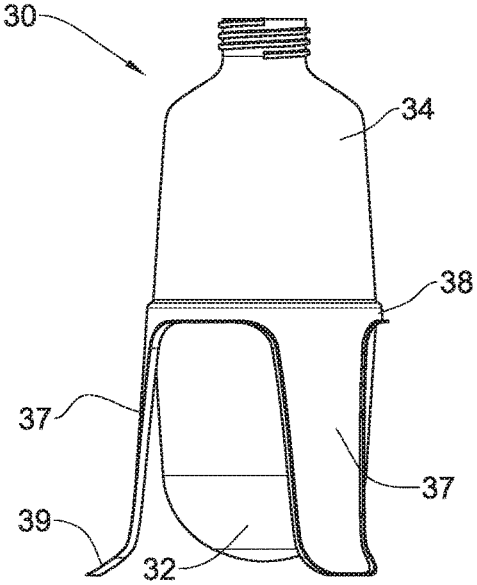
FIG. 4B is a partial cutaway side perspective view of the bottle of FIG. 4A.
Figure 4D:
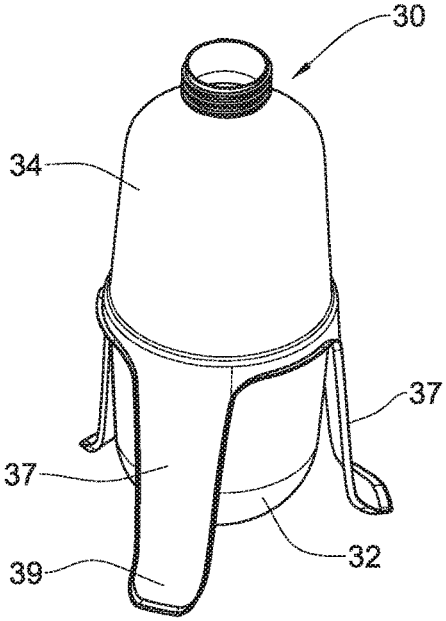
FIG. 4D is a top perspective view of the bottle of FIG. 4A.
Figure 5A:
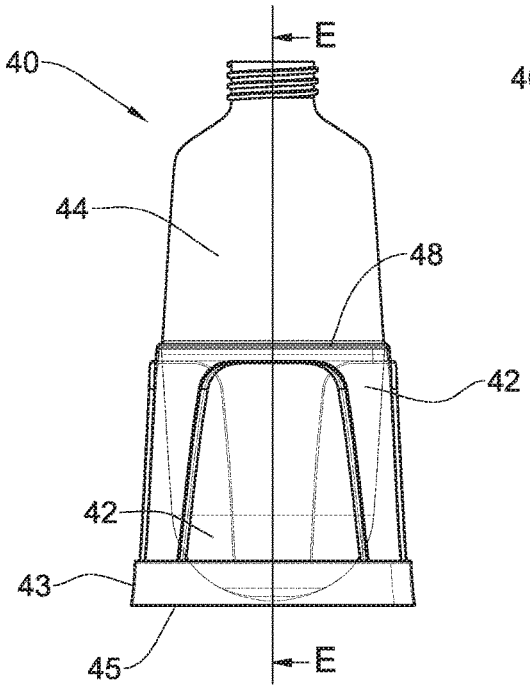
FIG. 5A is a side view of a bottle according to another example of the presently disclosed subject matter in the deployed position.
Figure 5C:
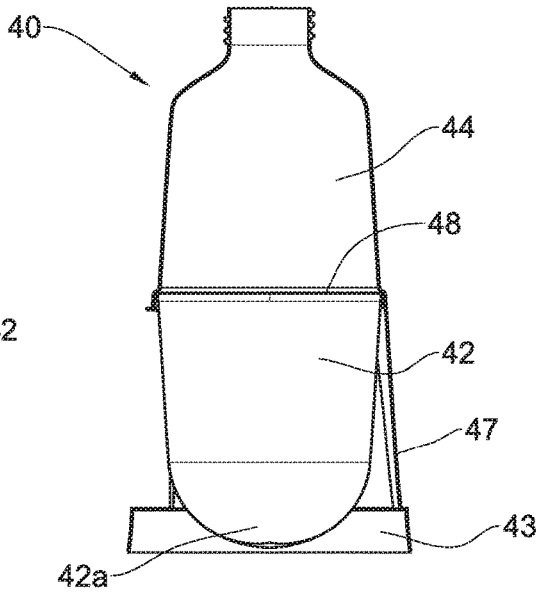
FIG. 5C is a partial cutaway side perspective view of the bottle of FIG. 5A.
Figure 5B:
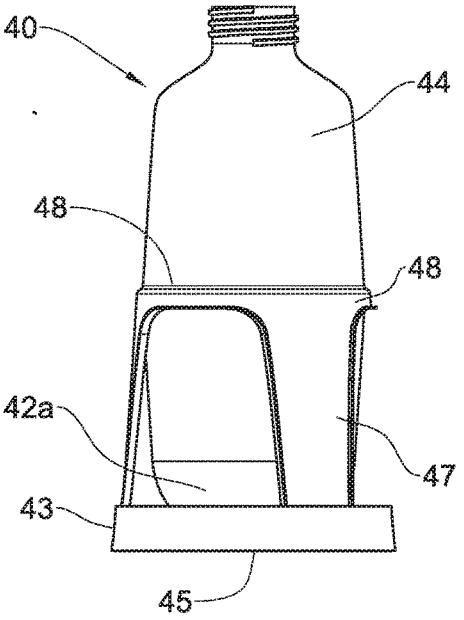
FIG. 5B is a partial cutaway side perspective view of the bottle of FIG. 5A.
Figure 5D:
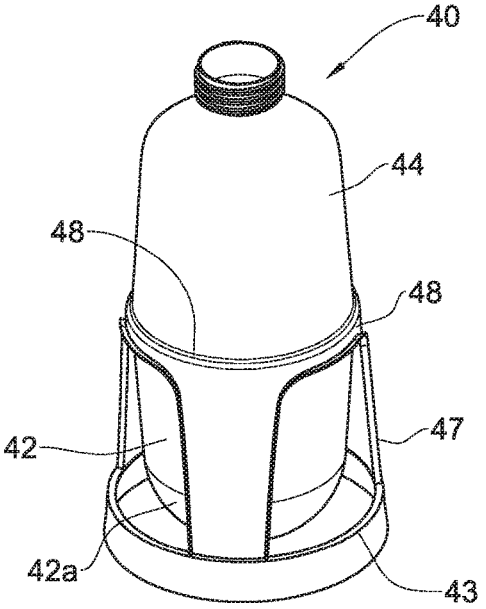
FIG. 5D is a top perspective view of the bottle of FIG. 5A.

FIG. 4A trough FIG. 4D illustrates a bottle 30 in accordance with another example of the presently disclosed subject matter. Bottle 30 is substantially similar to bottle 10 of FIGS. 1A through 2C, and includes a flexible portion 32 coupled to a rigid portion 34, and having a support structure 36. The support structure 36 according to this example includes three legs 37 each extending from a ring portion 38 mounted on the rigid portion 34 and having an extension 39 defined at the bottom end thereof. The extension 39 protrudes outwardly with respect to the bottle 30 and configured to provide the support structure 36 and, hence, the bottle with an additional stability.

FIGS. 5A through 5D illustrate a bottle 40 in accordance with yet another example of the presently disclosed subject matter. Bottle 40 is substantially similar to bottle 10 of FIGS. 1A through 2C, and includes a flexible portion 42 coupled to a rigid portion 44, and having a support structure 46. The support structure 46 according to this example includes three legs 47 each extending from a ring portion 48 mounted on the rigid portion 44 and coupled to a base member 43 disposed at the bottom of the bottle 40 underneath the flexible portion 42. It is appreciated that according to this example, since the base member 43 provides the bottle 40 with stability, the legs 47 can be slightly thinner than those of the previous examples. In order to allow the bottles to be stacked up on inside the other, the base member can be in a shape of a ring having a large aperture 45 at the center thereof. The aperture 45 has a diameter which is larger than the diameter of the rigid portion 44 and the ring portion 48, thus allowing another bottle to be stacked up one inside the bottle 40. Alternatively, the base member can be a separated element on which the bottle 40 is placed. For example, the base member 43 can include a seat (not shown) for the legs 47, such that when the bottle is used the legs 47 can be disposed in the seat and when it is desired to stack up bottles, the base member 43 is removed.

According to an example, the support structure can be a cylindrical member or conical member extending from the rigid portion to the bottom end of the flexible portion, such that when in the deployed position the container can be disposed in the upright position, supported by the cylindrical member or the conical member. The support member can be such which is detached from the rigid portion and can serve as a seat for the container.

According to an example the container can be a container assembly having a container and a standalone support structure. The container includes a rigid wall and a flexible wall portion such as described herein above, the support structure can be any of the support structure described hereinabove or herein after and can be configured as a separated element on which the container can be disposed.

The base member 43 can further include a concaved plate disposed substantially at the center thereof, and configured to hold the bottom end 42*a* of the flexible portion 42 when in the deployed position. The bottom end 42*a* of the flexible portion 42 can be rounded having a radius which is substantially similar to or smaller of that of the concaved plate, so as to allow the flexible portion to be stably disposed on the base member 43.

Figure 6C:
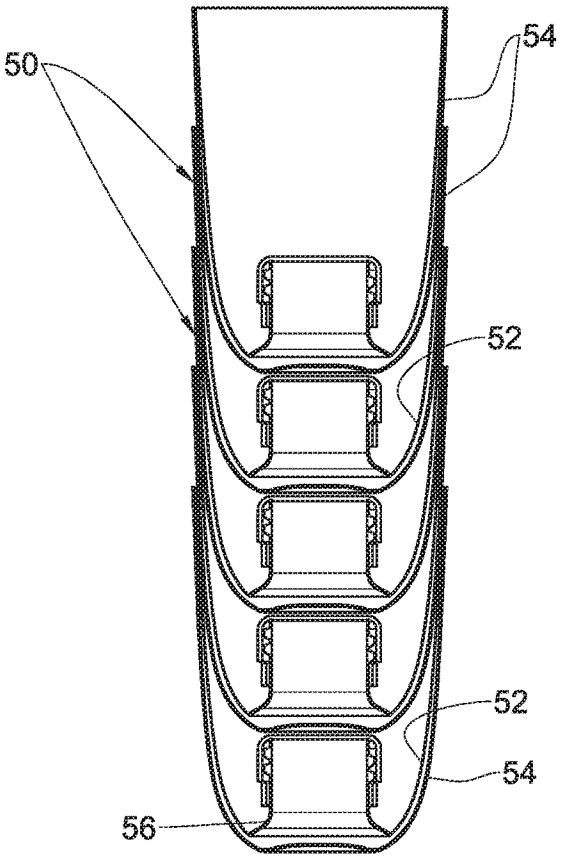
FIG. 6C is a side perspective of the bottles of FIG. 6A stacked up in a stack.
Figure 6B:
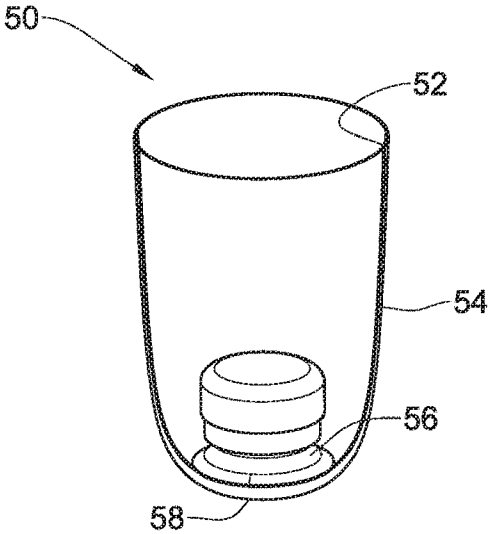
FIG. 6B is a side perspective view of the bottle of FIG. 6A in the folded position.
Figure 6A:
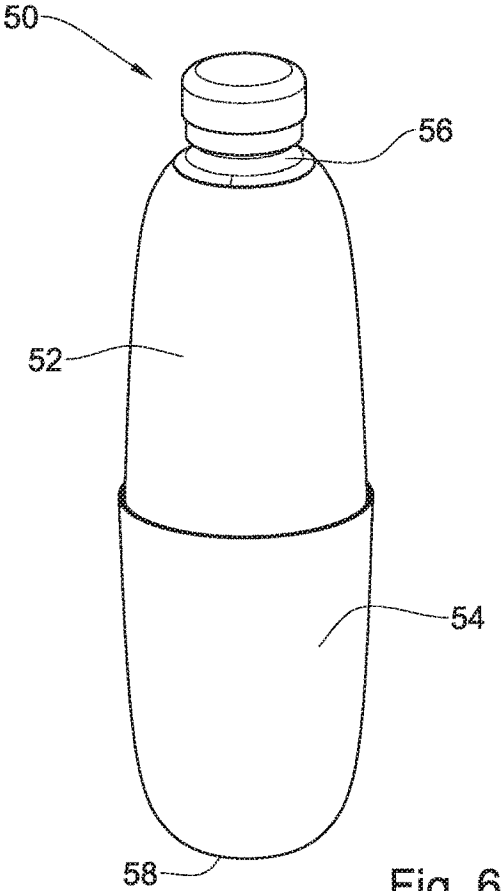
FIG. 6A is a side perspective view of a bottle according to another example of the presently disclosed subject matter in the deployed position.

FIGS. 6A through 6C illustrate a bottle 50 in accordance with another example of the presently disclosed subject matter. Bottle 50 includes a flexible portion 52 coupled to a rigid portion 54, at one end thereof and to a rigid neck portion 56 on the other end thereof. According to this example, the flexible portion 52 is disposed at the upper portion of the bottle, while the rigid portion 54 is disposed at the bottom portion thereof. This is as opposed to the previous examples, wherein the rigid portion is disposed at the upper portion of the bottle while the flexible portion is disposed at the bottom portion thereof.

According to this example, in the folded position, the flexible portion 52 is folded inside the rigid portion 54 such that the neck portion 56 is disposed substantially at the bottom of the rigid portion. As shown in FIG. 6C a plurality of bottles 50 can be stacked up one inside the other by inserting the rigid portion of one bottle inside that of another bottle while the flexible portion is folded therein. The bottom of the rigid portion 54 of a first bottle can be disposed substantially on top of the neck portion of the second bottle inside which it is stacked up.

According to one example, the bottle can be provided with a filling valve (not shown), for example at the bottom of the rigid portion 54. This way, the bottle can be filled by an automatic filling system through the valve, while the neck portion 56 can include a mouth cover with a cap.

Figure 7A:
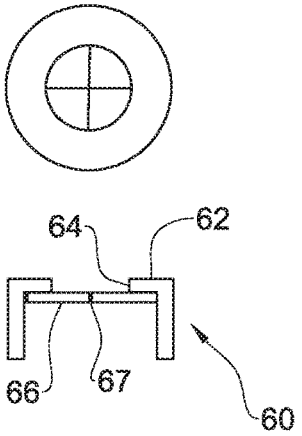
FIG. 7A is a side sectional view of a cover for a bottle according to one example of the presently disclosed subject matter.
Figure 7B:
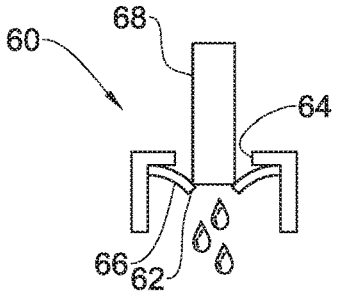
FIG. 7B is a side sectional view of the cover of FIG. 7A having a filing pipe inserted therein.

Referring now to FIGS. 7A through 9B, in order to allow an automatic filing of any one of the bottles described hereinabove, the cover on the mouth can be provided with a filling valve. In FIG. 7A there is shown a bottle cap 60 having a filling valve 62 in the form of an aperture 64. A sealing disc 66 is disposed on the aperture 64 and is mounted to the periphery thereof. The disc 66 includes a cut 67 at the, for example along the center thereof, which is configured to allow a filling pipe 68 to be inserted therein, as shown in FIG. 7B. When the pipe 68 inserted through the cut 67, the disc 66 is deformed and the area of the disc around the cut is urged inwardly, thus allowing the insertion of the pipe inside the bottle. When the pipe 68 is removed the disc 66 is urged back to its original form where the cut is sealed by the adjacent sides of the disc. It is appreciated that the cut can be formed in to perpendicular directions, thus facilitating the insertion of the pipe therein.

Figure 8A:
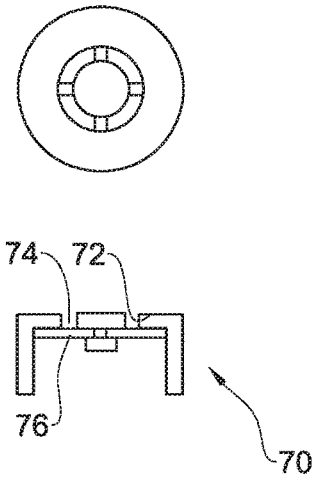
FIG. 8A is a side sectional view of a cover for a bottle according to another example of the presently disclosed subject matter.
Figure 8B:
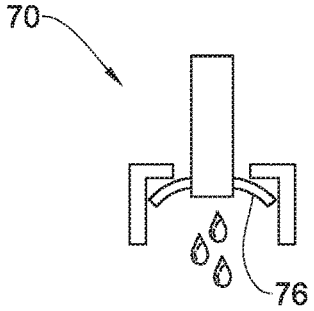
FIG. 8B is a side sectional view of the cover of FIG. 8A having a filing pipe inserted therein.

FIGS. 8A and 8B illustrated another example of a bottle cap 70 having a filling valve 72 in the form of an aperture 74. Similar to the previous example the valve 72 includes a sealing disc 76 disposed on the aperture 74. However, according to this example the disc 76 is mounted on the two opposing sides at the periphery thereof, while on the other portions of the periphery of aperture 74 the disc 76 is free to deform inwardly.

Figure 9A:
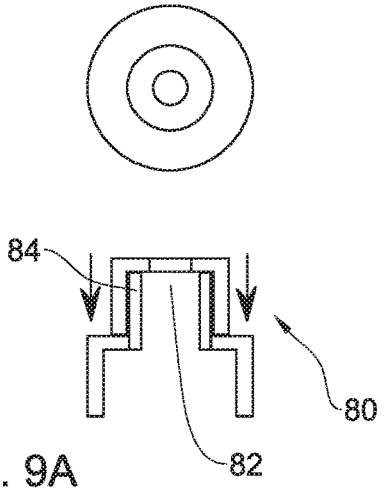
FIG. 9A is a side sectional view of a cover for a bottle according to another example of the presently disclosed subject matter.
Figure 9B:
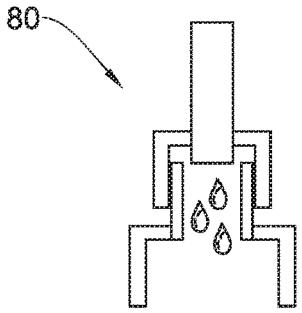
FIG. 9B is a side sectional view of the cover of FIG. 9A having a filing pipe inserted therein.

FIGS. 9A and 9B illustrates a further example of a bottle cap 80 having a filling valve 82. According to this example the filling valve is in the form of a port 84 having a slidable cover thereabout, such as known as a 'sport cap' bottle.

When the port 84 is in its open position a quick filling of the bottle can be carried out by coupling a filling pipe to the port 84.

According to one example, filling of the bottle can be carried out through an aperture extending through the rigid portion, for example the mouth of the bottle. The aperture can be covered with a breachable membrane. The membrane is resiliently configured such that when it is breached, for example by punctuating a filling needle therethrough, the membrane rebounds to a breached state. When the filling needle is removed the membrane is rebounded back to its original unbreached state covering the hole formed by the needle.

Figure 10:
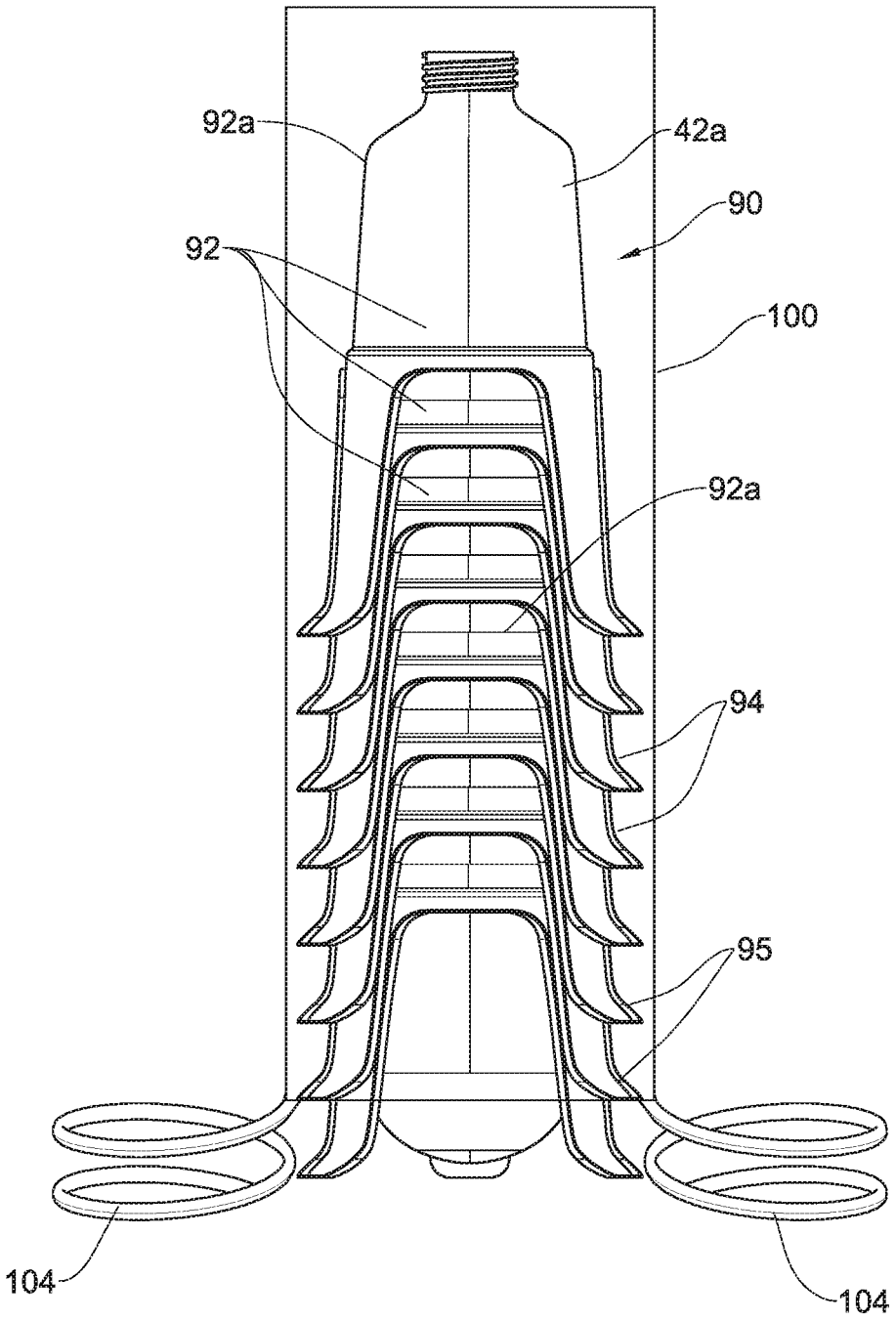
FIG. 10 is a side sectional view of cartridges having a stack of bottles disposed therein.

Further attention is drawn to FIG. 10, showing a stack of bottles 90 having a plurality of bottles 92, such as the bottle of FIG. 1A, having a rigid portion 92*a*, a flexible portion 92*b* and a support structure in the form of legs 94 extending downwardly. The stack 90 can be disposed in a cartridge 100 of a dispensing machine (not shown). The bottle are configured to be extracted from the cartridge 100 by an extraction mechanism, which according to the illustrated example is in the form of a helical spring 104 rotating about it axis. The legs 94 include a slight outwardly extension 95, such as described herein above with regards to the extension 39 of the bottle 30 of FIG. 4. The helical spring 104 is configured to engage the extension of the bottommost bottle 92 in the cartridge 100 and by rotating to urge the bottle downwardly. In order to facilitate the extraction process the extraction mechanism can be provided with a pair of helical springs 104 disposed at two substantially opposite sides of the cartridge 100 and configured for simultaneously rotating, thereby engaging the legs 94 of the bottle 92 and extracting it from the cartridge. It is appreciated that the bottle can include other means allowing it to be extracted rather than the extensions 95. For example the leg can include ridges defined along the length thereof. In addition, it is appreciated that the extraction mechanism can include any other means for extracting the bottles from the stack 90, as known.

Those skilled in the art to which the presently disclosed subject matter pertains will readily appreciate that numerous changes, variations, and modifications can be made without departing from the scope of the invention, mutatis mutandis.

The invention claimed is:

1. A container, comprising:

a rigid wall portion having an opening, an inner rigid surface and an outer rigid surface;

a flexible wall portion having an outer flexible surface and an inner flexible surface having a portion coupled to a portion of the inner rigid surface; and a support member coupled to said rigid wall portion configured for providing the container with stability;

wherein the flexible wall portion is configured to be selectively disposed in a folded position in which the flexible wall portion is folded inside the rigid wall portion and the inner flexible surface is at least partially adjacent the inner rigid surface for allowing the rigid wall portion stacking therein a rigid wall portion of a second container, and a deployed position, in which the flexible wall portion extends outwardly from the rigid wall portion thereby expanding an inner volume of the container and allowing said rigid wall portion and said flexible wall portion to form together a structure configured for holding fluids.

2. The container according to claim 1, wherein said rigid wall portion includes a neck portion having a mouth.

3. The container according to claim 1, wherein said portion of said inner flexible surface is welded to the portion or the inner rigid surface.

4. The container according to claim 1, wherein the rigid wall portion further comprises a skirt protruding outwardly with respect to said outer rigid surface and including said opening and said portion of the inner rigid surface.

5. The container according to claim 1, wherein the support structure is integrally formed with the rigid wall portion.

6. The container according to claim 1, wherein said rigid wall portion includes a diameter gradually increasing from a neck portion thereof towards said opening such that the rigid wall portion of the second container can be disposed therein.

7. The container according to claim 1, wherein said support structure is configured to fasten said flexible wall portion to said rigid wall portion.

8. The container according to claim 7, wherein said support structure comprises a snap coupling arrangement configured for coupling thereof to said rigid wall portion.

9. The container according to claim 8, wherein said opening of the rigid wall portion is provided with a coupling portion defined about the circumference thereof and configured to receive therein a corresponding coupling portion defined on said support structure wherein said corresponding coupling portion is configured for snap coupling with the coupling portion.

10. The container according to claim 1, wherein the flexible wall portion is disposed at the upper portion of the container when the container is disposed in an upright position, while the rigid wall portion is disposed at the bottom portion thereof, and wherein in the deployed position, the flexible wall portion extends upwardly from the rigid wall portion.

11. A container assembly, comprising:

a container comprising a rigid wall portion having an opening, an inner rigid surface and an outer rigid surface; and a flexible wall portion having an outer flexible surface and an inner flexible surface having a portion coupled to a portion of the inner rigid surface, wherein the flexible wall portion is configured to be selectively disposed in a folded position in which the flexible wall portion is folded inside the rigid wall portion and the inner flexible surface is at least partially adjacent the inner rigid surface for allowing the rigid wall portion stacking therein a rigid wall portion of a second container, and a deployed position, in which the flexible wall portion extends outwardly from the rigid wall portion thereby expanding an inner volume of the container and allowing said rigid wall portion and said flexible wall portion to form together a structure configured for holding fluids; and a support member configured to dispose thereon said container for providing stability thereto.

12. The container assembly according to claim 11, wherein said support member is configured to allow standing the container in an upright position.

13. The container assembly according to claim 11, wherein the support member comprises three legs, coupled to the container.

14. The container assembly according to claim 11, wherein said support structure comprises a snap coupling arrangement configured for coupling thereof to said rigid wall portion.

15. The container assembly according to claim 13, wherein each of said three legs is coupled to a base member disposed at the bottom thereof.

16. The container assembly according to claim 15, wherein said base member has a shape of a ring having an aperture at the center thereof the diameter of which is larger than the diameter of the rigid wall portion.

17. The container according to claim 1, wherein the rigid wall portion is disposed at the upper portion of the container when the container is disposed in an upright position, while the flexible wall portion is disposed at the bottom portion thereof, and wherein in the deployed position, the flexible wall portion extends downwardly from the rigid wall portion.

18. A container assembly, comprising:

a container comprising a rigid wall portion having an opening, an inner rigid surface and an outer rigid surface; and a flexible wall portion having an inner flexible surface, an outer flexible surface and a corresponding opening coupled to the opening of the rigid wall portion, wherein the flexible wall portion is configured to be selectively disposed in a folded position in which the flexible wall portion is folded inside the rigid wall portion and the inner flexible surface is at least partially adjacent the inner rigid surface for allowing the rigid wall portion stacking therein a rigid wall portion of a second container, and a deployed position, in which the flexible wall portion extends outwardly from the rigid wall portion thereby expanding an inner volume of the container and allowing said rigid wall portion and said flexible wall portion to form together a structure configured for holding fluids; and a support member configured to disposed thereon said container for providing stability thereto, wherein said support structure comprises a snap coupling arrangement configured for coupling thereof to said rigid wall portion.

* * * * *